United States Patent [19]

Bachmann et al.

[11] Patent Number: 4,567,746

[45] Date of Patent: Feb. 4, 1986

[54] METHOD AND APPARATUS FOR MAKING SHELLS FOR CANS

[75] Inventors: Henry C. Bachmann; Ermal C. Fraze, both of Dayton, Ohio

[73] Assignee: Dayton Reliable Tool & Mfg. Co., Dayton, Ohio

[21] Appl. No.: 571,237

[22] Filed: Jan. 16, 1984

[51] Int. Cl.[4] ..... B21D 22/00

[52] U.S. Cl. ..... 72/348; 72/336; 413/56

[58] Field of Search ..... 72/347, 348, 404, 405, 72/336, 345, 346, 361; 220/67, 66; 413/56

[56] References Cited

U.S. PATENT DOCUMENTS

| | | | |
|---|---|---|---|
| 3,537,291 | 10/1967 | Hawkins | 72/336 |
| 3,948,162 | 4/1976 | Numba | 72/405 |
| 3,952,677 | 4/1976 | Hartman et al. | 220/66 |
| 3,957,005 | 5/1976 | Heffner | 72/348 |
| 4,026,226 | 5/1977 | Hahn et al. | 72/405 |
| 4,157,693 | 6/1979 | Openchowski et al. | 72/348 |
| 4,215,795 | 8/1980 | Elser | 220/67 |
| 4,291,567 | 9/1981 | Murayama | 72/347 |
| 4,382,737 | 5/1983 | Jensen et al. | 72/348 |
| 4,448,322 | 5/1984 | Kraska | 220/67 |

*Primary Examiner*—Francis S. Husar
*Assistant Examiner*—Robert Showalter
*Attorney, Agent, or Firm*—Biebel, French & Nauman

[57] ABSTRACT

The disclosure relates to method and tools for making shells used in the manufacture of can ends. A first set of tools makes blank pre-forms having a substantially flat central panel and an upward-extending chuckwall about the edge of the panel. The junction area between the panel and the chuckwall has a relatively large radius of curvature at this time. A second set of tools forms on the blanks a lip extending outward from the upper end of the chuckwall and generally parallel to said panel; then the panel and the chuckwall are separately gripped, followed by relative movement between the panel and the chuckwall while wrapping the junction area around a forming punch to form a panel wall in the junction area extending upward from the inner part of the chuckwall. Then the lip is formed into a curl edge section which ends in an inner curl diameter that is round and concentric with the chuckwall. Methods and apparatus are disclosed for (a) separating the pre-forms at the first tools and then transferring them individually to the second tools, or (b) partially separating the pre-forms at the first tools and using the advancing sheet metal stock to carry the pre-forms to the second tools. Also disclosed are various tool layout modifications for use in different types of single acting or double acting reciprocating presses.

28 Claims, 24 Drawing Figures

METHOD AND APPARATUS FOR MAKING SHELLS FOR CANS

BACKGROUND OF THE INVENTION

This invention relates to metal shells used to form ends of can type containers. Many can type containers, for example beer cans and soft drink cans, are required to withstand internal pressure, rough handling, and substantial temperature differences, yet maintain a complete hermetic seal to protect the contents of the can. Cans of this type are used in very large volumes, billions of cans per year, and at present the metals most used for this purpose are aluminum and steel.

The typical modern can consists of a unitary deep drawn body, usually with a necked inward throat at the top which terminates in an outwardly extending body curl, and an end for the can which comprises the shell (to which the present invention pertains) provided with self-opening structure such as tear tabs and related score lines in the shell. The shells are manufactured from sheet metal by severing a suitable blank from a strip thereof, forming the blank to define a central panel surrounded by a reinforcing countersink and chuckwall configuration, and a shell curl which is designed to interact with the body curl in seaming apparatus, to attach the end to the can with the requisite hermetic seal. In most instances the underside of the shell or end curl is provided with a sealing compound to assist in the formation of the seal.

The shell is the basic part of the end and is operated upon in converting apparatus which adds the desired score lines, tear tab, and the integral rivet attachment between the shell and the tab, all in known manner. The sealing compound may be applied to the underside of the shell, specifically to the downward facing or bottom portion of the shell curl, either before or after the converting operation, or after, the former being more typical.

One of the major endeavors of designers of can ends is to provide a shell of as thin material as is possible, since this can result in substantial savings of material, and therefore expense. However, the integrity of the shell, and its ability to withstand buckling from internal pressures in particular, impose restrictions upon the use of very thin material in the shell formation. The ability of the thin metal to withstand the drawing and working imposed upon the blank during the formation of the shell generally calls for use of somewhat thicker metal, in order to accommodate thinning in the region where the reinforcing structure is formed in the shell.

In typical prior art operations for the forming of shells, a blank is severed from metal sheet material and it is then formed to a shape comprising a generally flat central panel and a chuckwall extending, in this initial stage, upwardly and outwardly from the central panel, blending into a curved flanged portion. In one prior art method the blank is formed to include a groove around the central panel inward from the chuckwall. This initial blank is then subjected to a rotary curling operation to form a curled edge on the flange, the curled edge being turned somewhat under the flanged portion.

From the curling operation, the partially formed shells are fed through further tooling where they are gripped in the flange portion, while the curled edge is protected in the tooling against deformation. If the groove is already in the blank, then the groove may be reformed. If not, the thus clamped blank is moved against a stationary support applied against the major underside of the central panel.

There is an unsupported region in the shell comprising the edge of the central panel which overlaps and extends beyond the stationary support, out to the region where part of the chuckwall is clamped. This action places the blank in compression, and results in a reshaping of the unsupported band of material between the chuckwall and the central panel, into a shape which defines a reinforcing channel or countersink at the bottom of the chuckwall and into the periphery of the central panel. Thus, the formation of the end shells according to the prior art requires a three stage operation including in some cases a rotary curling step, and the above described formation of a reinforcing channel shape into the shell results from a working of a band of the metal blank between the chuckwall and the central panel which is essentially uncontrolled and thus susceptible to breaks, distortion, or potential thinning of the shell at this critical point in its structure.

SUMMARY OF THE INVENTION

The present invention, therefore, provides methods and apparatus in which shells are manufactured at a high rate, having more uniform thickness throughout, including the requisite chuckwall and the reinforcing panel wall connecting between the chuckwall and the central panel of the shell. In addition, the shells have an improved partial curl at their periphery in which the inward edge of the curl is pre-formed such that during the seaming operations, when the end formed from the shell is attached to a can, the curl will roll smoothly into the curled seam, minimizing the possibility of wrinkled seams and/or punctures or cuts of the can neck in the region of the seam.

The invention provides finished shells, and processes of manufacturing such shells, in which the shells are formed in multiple steps by reciprocable tooling in one or more types of presses and no additional curling or the like is necessary to finish the desired pre-formed curl at the periphery of the shell.

The object of the invention, therefore, is to provide a unique shell for making can ends which is characterized by more uniform concentricity of the inner and outer curl with the chuckwall, more uniform thickness especially through the connection between the chuckwall and the central panel, and an improved pre-formed curl around the periphery of the shell, by the use of reciprocating presses which can manufacture such shells rapidly in large quantities; to provide improved methods for making such shells including controlled formation of the junction area between the chuckwall and the central panel of the shells, and of the pre-curled outer portion of the shells, whereby a more uniform thickness of the shell material is maintained; and to provide two station tool arrangements for various types of reciprocating presses, which tools permit high capacity precision manufacturing of such shells without any rotary step and with minimum waste of sheet stock, and using thinner stock than previously possible, to achieve highly efficient shell production.

Other objects and advantages of the invention will be apparent from the following description, the accompanying drawings and the appended claims.

DESCRIPTION OF THE PREFERRED EMBODIMENT

Figure 3:
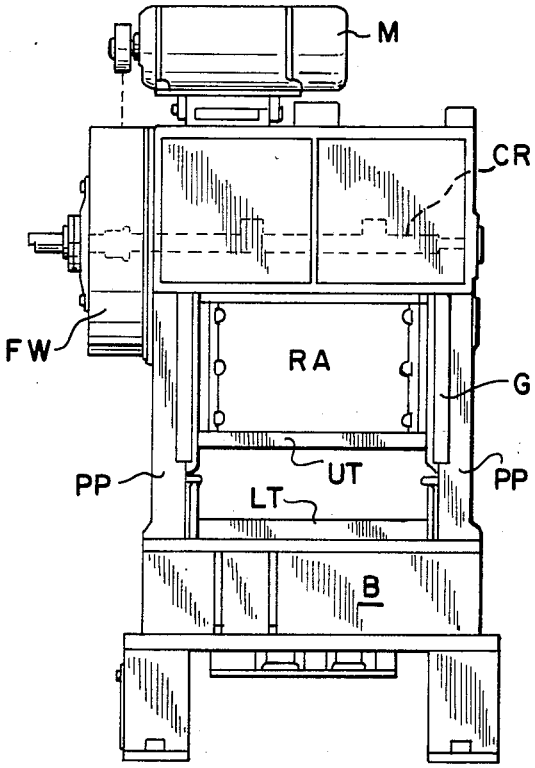
FIGS. 3 and 4 are, respectively, front and side views of a typical single acting press as utilized in preferred systems of the present invention.
Figure 4:
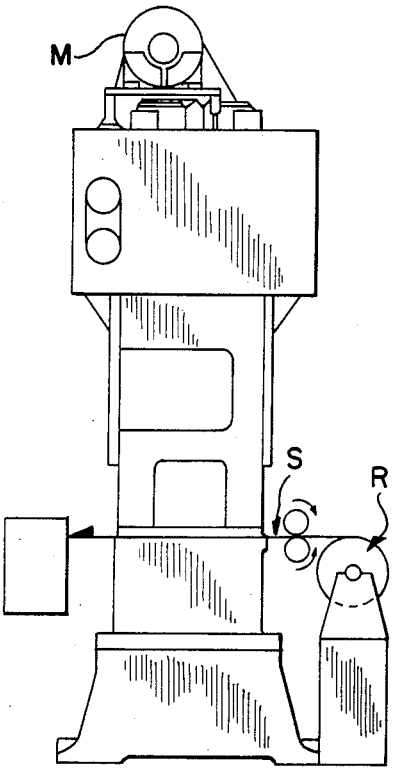

The making of a shell according to the invention is generally divided into two operations, each of which can be carried out within conventional reciprocating presses having specially adapted tooling. A typical single acting press utilized might be a Minster P2-45, which type is shown in FIGS. 3 and 4. Such a press includes a drive motor M coupled to a flywheel FW on the press crankshaft CR which reciprocates the ram RA along gibs G that are mounted to posts PP extending upwards from the bed BA. The upper tooling UT is fixed to the bottom of the ram, and the cooperating lower tooling LT is fixed to the top of the bed.

The relatively thin metal stock S, from which the shell is formed, is fed incrementally from a roll R into the front of the press, to first tool stations within the press. The press ram operates at each of these first stations 10*a, b, c* and *d* (FIG. 12) to form blanks B (FIGS. 5–8) from the stock, and to form shell pre-forms from the blanks. The partially completed shells or pre-forms are then transferred to corresponding second tool stations 12*a, b, c* and *d* where the forming of the shells is completed and the shells are discharged from the sides of the press. The scrap exits the rear of the press into a conventional chopper (not shown), from which the scrap is collected to be reclaimed.

In certain preferred embodiments of the invention, for each stroke of a press partially formed shells are finished by each second tooling station while blanks are partially formed by each first station tooling. Moreover, in some embodiments the transfer of shells between stations is accomplished so quickly that shells partially formed at first stations by one press stroke are completed at the second station by the next succeeding stroke. Details of suitable transfer mechanisms are disclosed in copending application Ser. No. 571,051 filed concurrently with this application and having the same assignee.

Figure 12:
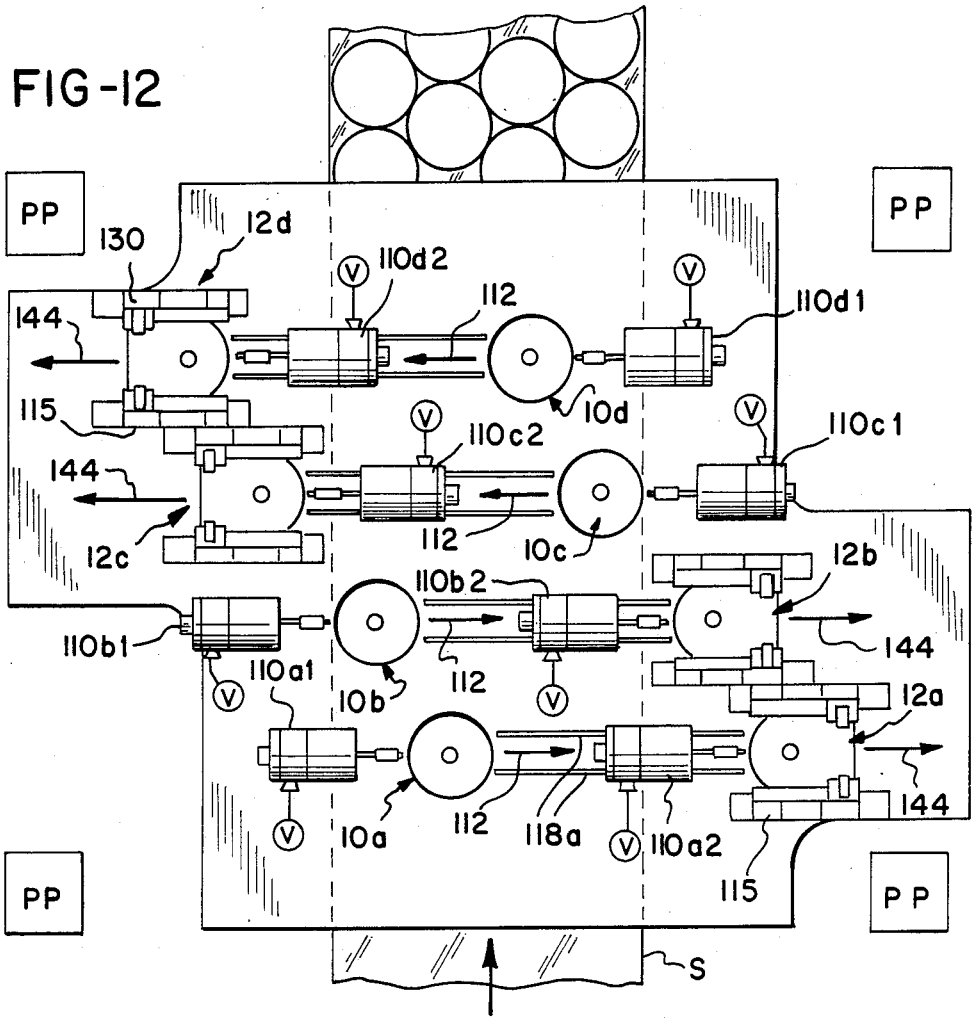
FIG. 12 is a schematic plan view of multiple dual tool stations in a press of the type shown in FIGS. 3 and 4.

It will be noted from FIG. 12 that the first tooling stations 10*a, b, c*, and *d* are spaced apart so as to remove blanks from the stock across its entire width and along its length to maximize utilization of the stock material, even though the scrap is reclaimed. These stations are also spaced according to the step-wise advace of the stock, in the direction of the arrow. The second tooling stations are located outwardly of the path of the stock, along the transfer mechanisms as later described. The layout of the first and second tooling stations is ideally arranged within the area of the bed and ram of the press so as to distribute the loading on the press in as symmetrical a manner as is possible.

Figure 1:
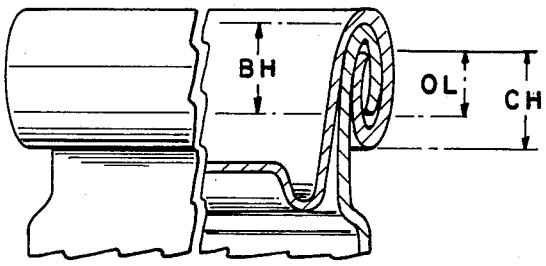
FIG. 1 is a view of the top of a typical beverage can, with a portion broken away and shown in cross-section to illustrate the seam between the can body and the end.
Figure 2:
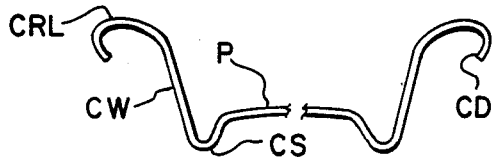
FIG. 2 is a broken and shortened cross-sectional view of a shell for a can end, as provided by this invention.

FIG. 2 shows in cross-section, substantially enlarged beyond the normal size of an actual shell, the configuration of a finished shell as provided by the invention; the central panel is broken to shorten the view. The shell is, of course, an integral metal part, made from a suitable metal blank, shaped as previously described, and in its final configuration including a flat central panel P, a countersunk reinforcing area CS extending into a relatively straight upward and outward shaped chuckwall CW, and a lip or curl edge portion CRL which terminates at the inner curl diameter CD, all formed by reciprocating tooling without rolling or turning operattions.

First Station Tooling and Operation

The tooling for the first stations is shown in FIGS. 5–8, it being understood the upper tooling UT is connected for operation by the press ram, while the lower tooling LT is fixed to the press frame at the top of the bed.

The lower tooling includes die cut edge 14, over which the metal stock S as it enters the tooling at a level generally indicated by line 16. Die cut edge 14, along with die form ring 18 are solidly supported on a suitable base member. Additionally, the lower tooling includes draw ring 24, positioned between die form ring 18 and die cut edge 14. A center pressure pad 25 is located concentrically within form ring 18. Draw ring 24 is supported by springs (not shown), mounted in the base member, which, compress due to pressure exerted upon draw ring 24 when the tooling is closed. The center pressure pad 25 is also supported by a spring (not shown) which will compress in response to force exerted by the upper tooling.

When the tooling is open, draw ring 24 and center pressure pad 25 are retained in the lower tooling with draw ring 24 bottoming against die cut edge 14 and center pressure pad 25 against form ring 18. The uppermost surface of draw ring 24 is then at a position some distance below the lowest point of shear on the die cut edge 14, while the uppermost surface of the center pressure pad 25 is some distance above draw ring 24 and below the lowest point of shear on die cut edge 14.

The upper tooling is provided with blank punch 30 positioned to cooperate with draw ring 24 for as the tooling is closed. A knockout and positioner 32 is located above die form ring 18, and punch center 34 is provided with an appropriate configuration to produce the partially completed shell, as well as to clamp a blank in cooperation with center pressure pad 25. Blank punch 30, knockout and positioner 32, and punch center 34 are all closed simultaneously upon the lower tooling as the press ram is lowered.

Figure 5:
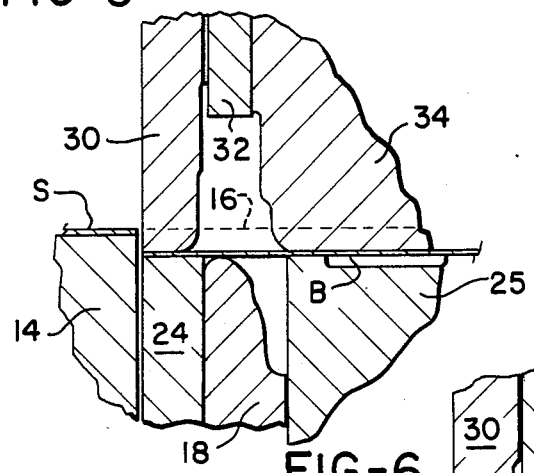
FIGS. 5, 6, 7 and 8 are enlarged (beyond actual size) partial cross-sectional views of tooling used in accordance with the invention at a first operating station to form a partially completed shell.
Figure 6:
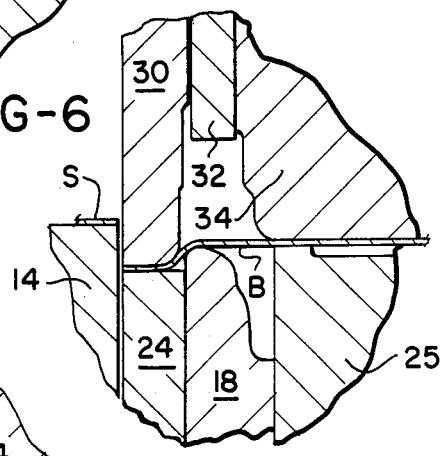

The sequential operation of the first station tooling to produce the blank from the stock and partially form a shell is shown in FIGS. 5–8. In FIG. 5, the tooling is shown already partially closed. The stock S enters the tooling along a line indicated at 16, and as the press ram is lowered, a flat blank B is produced by shearing the stock material between die cut edge 14 and blank punch 30.

Since the blank punch 30 and punch center 34 move simultaneously, the lowermost surface of blank punch 30 must lead the lowermost surface of punch center 34 by some distance so punch center 34 does not interfere with the stock S during blanking.

Further, the distance by which blank punch 30 leads punch center 34 is less than the distance at which the uppermost surface of center pressure pad 25 is above the uppermost surface of draw ring 24 in lower tooling 12. This causes the entire central panel of blank B to be clamped between punch center 34 and center pressure pad 25 first, followed by pinching of the outermost part of blank B between blank punch 30 and draw ring 24 before any forming begins. Use of the central clamping secures the blank B in a centered position within the tooling during subsequent forming of a shell from the blank. Holding the blank in a centered position contributes to controlled working of the blank and minimizing variation in the curled lip portion CRL provided at the outer edge of the completed shell, providing a more even amount of material for later seaming.

As the press ram continues downward, the blank punch 30, support ring 32, and punch center 34 all continue to move simultaneously. At the point illustrated in FIG. 5, the blank is still pinched between blank punch 30 and draw ring 24 and between punch center 34 and pad 25, beginning the formation of the shell over die form ring 18. It will be noted that as the blank B is formed over form ring 18, it is pulled from between blank punch 30 and draw ring 24.

Figure 7:
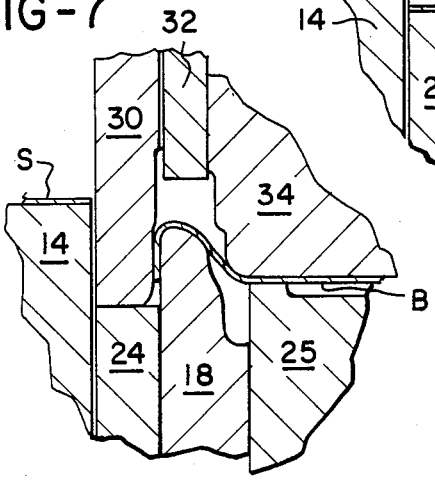

Referring to FIG. 7, the press ram continues to move downward as the punch center 34 begins to form the chuckwall CW on blank B. The blank material is no longer held between the blank punch 30 and the draw ring 24, but is still held between punch center 34 and pad 25, and the draw ring 24 no longer controls the formation of the shell. The clearance between the inside diameter of the blank punch 30 and the outside diameter of the die form ring 18 is selected to provide an appropriate amount of drag or resistance on the blank B to insure proper formation. The inside diameter of blank punch 30 slightly narrows (shown exaggerated for clarity). Thus, near the end of the press stroke, as can be seen by comparing FIGS. 7 and 8, the drag on the outermost portion of blank B is increased. This is to insure that this portion of the resulting shell pre-form is drawn more tightly over die form ring 18 so that the curl found in shell 48 extends to the very edge of the pre-form, without any straight or less than fully curled portions.

Figure 8:
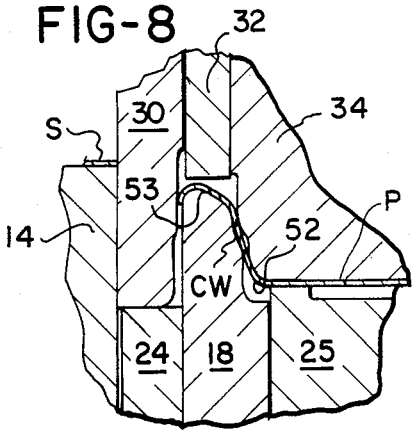

In FIG. 8, the tooling is shown in its closed position with the press ram bottomed against appropriate stop blocks. The first portion of the shell formation operation is completed, with the flat central panel P terminating at a relatively large radius area 52 to produce a soft stretch so as not to overwork the material in this area. The large radius area 52 forms the junction region of chuckwall CW with the central panel, and will later form the shell countersink and panel form radius. A sufficiently large radius is provided that a much tighter radius can later be provided for the shell countersink while maintaining sufficient material thickness. It can be seen from FIG. 8 that the reverse bends applied to the inner wall of die center form ring 18 and the outer wall of punch center 34 serve to produce a straight chuckwall CW without either inward or outward bowing, enabling the shell to fit accurately within the second station tooling.

The shell is further provided with a lip 53 extending generally outwardly and upwardly from the chuckwall 51, but having general downward curvature. Lip 53 is provided with two distinct curvatures, giving lip 53 a "gull-wing" cross-sectional configuraion. Its portion adjacent chuckwall CW has only slight relative curvature and thus provides the upward extension of lip 53, while the outermost portion is provided with a relatively sharp downward curvature by dieform ring 18. However the outer edge of lip 53 is located to at least even with, if not above, the point where lip 53 connects with the shell chuckwall CW.

Upon closure of the tooling, knockout and positioner 32 does not contact the partly completed shell. Once the forming operation has been completed, the press ram is raised to open the tooling, and the shell pre-form is held within blank punch 30 by the tight fit of its lip 53 therein, and is carried upward by the upper tooling. Once the lowermost portion of the shell pre-form has cleared the stock level indicated in FIG. 5 at 16, knockout and positioner 32 halts its upward movement while blank punch 30 and punch center 34 continue to rise with the press ram. When upward movement of knockout and positioner 32 is stopped the shell pre-form will contact it, and this pushes the shell pre-form from within the still-moving blank punch 30.

The partly formed shell pre-form is then held in position on knockout and positioner 32 through application of a vacuum, via appropriate passageways (not shown) through the upper tooling to the surface of punch center 34. This vacuum then causes the shell pre-form to adhere to the surface of knockout and positioner 32 until it is removed.

Upon completion of the first operation the shell preforms are moved by transfer systems such as described in copending U.S. application Ser. No. 571,051 filed Jan. 16, 1984, to a corresponding one of a plurality of second stations for completion of the formation process.

Second Station Tooling and Operation

Figure 9:
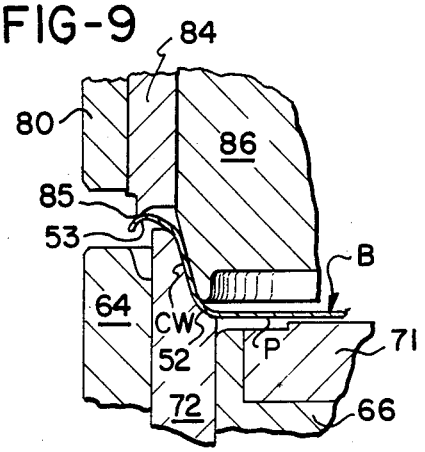
FIGS. 9, 10 and 11 are similar enlarged partial cross-sectional views of the tooling and its sequential operation at a second station to complete the formation of shells in accordance with the invention.
Figure 10:
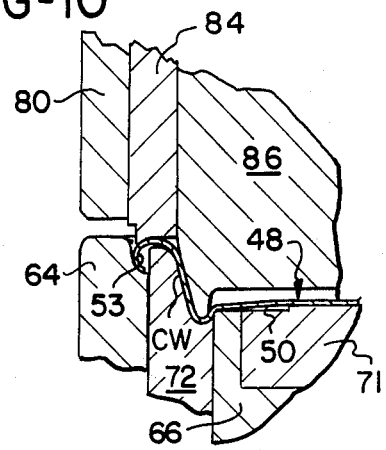
Figure 11:
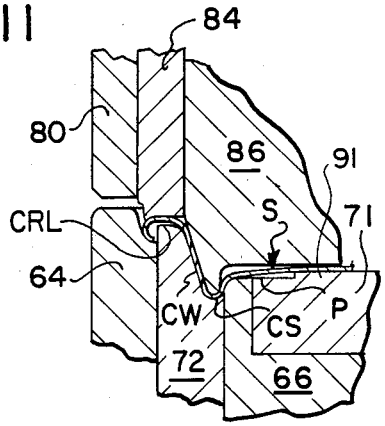

The tooling for the second station is shown in FIGS. 9–11, including appropriate upper tooling supported on the press ram and lower tooling supported on the press bed. The lower tooling includes a curl die 64 and panel form punch 66, both fixed in turn to suitable base members. An insert 71 is mounted within panel form punch 66. A spring pessure pad 72 is concentrically mounted between curl die 64 and panel form punch 66, supported by a plurality of springs (not shown) mounted within the base which supports the lower tooling. Vacuum passageways (not shown) supply vacuum to the upper surface of panel form punch 66.

The upper tooling includes a curl form punch and positioner 84 having a projection 85 for defining the forming characteristics of the lower surface of form punch and positioner 84. Additionally, panel form die 86 is mounted generally for movement along with the form punch and positioner 84. Panel form die 86 is supported from the press ram through a plurality of springs (not shown), which are selected to provide a "dwell" in the downward movement of panel form die 86 as the press ram is lowered. Further, vacuum passageways (not shown) are provided through panel form die 86, form punch and positioner 84, and their mounting respectively, thus vacuum may be supplied to the lower face of panel form die 86.

The sequential operation of the tooling of each of the second stations for completion of a shell is shown in detail in FIGS. 9–11. The shell pre-form enters the open tooling of the second station and is properly positioned on the lower tooling. The large radius area 52 and chuckwall CW are supported by the spring pressure pad 72, with the entire central panel P supported some distance above insert 71. The shell pre-form is located and held in place by the vacuum supplied to the upper surface of panel form punch 66.

In FIG. 9, lowering of the press ram causes panel form die 86 to contact chuckwall CW, clamping it between panel form die 86 and spring pressure pad 72. The spring pressure on form die 86 is selected to be more easily compressible than the springs supporting the pressure pad, so that once contact with chuckwall CW is made, panel form die 86 is held in position by spring pressure pad 72 and begins to dwell despite further lowering of the press ram. Subsequently, form punch and positioner 84 contacts lip 53.

As seen in FIGS. 9 and 10, continued downward movement of the press ram causes the form punch and positioner 84 to begin to push shell lip 53 toward its intended final configuration. The shell pre-form continues to be clamped between panel form die 86 and spring pressure pad 72, with panel form die 86 continuing to dwell until downward movement of the press ram causes panel form die 86 to bottom against an upper base plate (not shown).

Further downward movement of the tooling by the press ram causes the panel form die 86 to move downward, as shown in FIG. 10, forcing the spring pressure pad 72 to move downward as well. Insert 71 includes a raised center 91 which now is positioned against the shell pre-form panel 50. Downward movement of spring pressure pad 72 effectively causes upward movement of the panel P with respect to the remainder of shell pre-form, reducing the distance between the uppermost portion of the shell pre-form and its panel P. The shell material from the large panel radius area 52 begins to pull away from the spring pressure pad 72 and wrap around the edges of the panel form punch 66 and the panel form die 86 (FIGS. 9 and 10). The wrapping action takes place under precise control with little drawing of the shell material, to produce a pressure resistant panel for the completed shell by reforming the large radius area 52 into the countersink CS. Raised center portion 91 of insert 71 causes panel P to be bowed slightly upward. This is to counteract a tendency of panel P to bow downwardly during shell forming, and thus resulting in a flat finished panel. Simultaneously, the shell lip 53 enters the curl die 64 for final shaping.

The tooling is shown in its closed position in FIG. 11. The completed shells now include a pressure resistant panel P surrounded by countersink CS and a die curled lip CRL having a hook portion, i.e. an outer curl edge section of relatively lesser radius of curvature, suitable for seaming onto a can. The reasons for formation of the "gull-wing" lip 53 at the first station can now be readily appreciated. By pre-curling the outer portion of the lip to a relatively sharp radius, extending to the edge of the shell, the natural tendency of the outermost edge to resist die curling and remain relatively straight can be overcome. Moreover, by forming the less sharply curved portion of the lip at the first station, so as to extend upwardly as well as outwardly from chuckwall CW, some travel distance is provided for lip 53 during die curling of the outermost portion. If lip 53 were to be formed at the first station to extend from chuckwall CW at the final desired angle, satisfacory die curling of the outer edge cannot be accomplished.

The result of these operations is to produce a shell which is characterized by its more uniform thickness throughout its cross section, and by uniformity of the spacing between chuckwall CW and the inner curl diameter CS (See FIG. 2).

Referring back to FIG. 12, stock is fed into the press between the upper and lower tooling and beneath base member 102 supporting the transfer apparatus. Each of the first stations 10*a*–10*d* includes a corresponding driver 110*a*1–110*d*1 as part of the associated transfer mechanism. Following completion of the operation at the first stations, the corresponding driver are actuated simultaneously to transfer the shell along the transfer path as indicated by arrows 112 to a corresponding second station 12*a*–12*d*.

At each second station fingers 115 operate to accurately position the shell within the lower tooling of the second station. During the next stroke of the press the tooling at each second station closes, thereby completing formation of each shell. Following opening of the tooling, a corresponding driver 110*a*2–110*d*2 is actuated to transfer the completed shells from each of the second stations 12*a*–12*d*, as indicated by arrows 144. At the same time that formation of the shells is completed within the second stations the next succeeding set of four blanks is punched from the stock S and partially formed within the first station.

Side to Side Stock Feed

Figure 13:
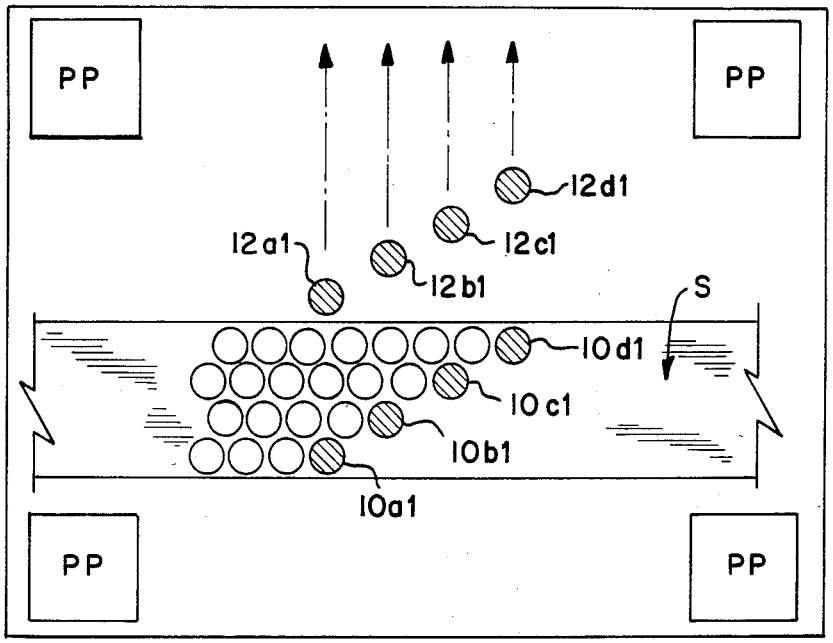
FIG. 13 is a schematic plan view similar to FIG. 12, showing another embodiment of multiple tool stations.

Referriing to FIG. 13, another embodiment is illustrated schematically, wherein the stock S is fed, in incremental fashion, into a press from one side to the other, rather than front to back as previously described. The posts PP of the press are shown diagramically for purposes of orienting this arrangement. The strip of stock material S thus is fed side-to-side through the press, as indicated by the direction of arrow thereon, and four first tooling stations 10*a*1–10*d*1 are located spaced apart along a line extending diagonally of the strip path. Like reference numerals are used, because the details of the tooling are the same as previously described, the difference in this embodiment being the layout of the tooliing stations and the passage of the stock and of the discharged shells.

The shell pre-forms are transferred, by the same type of transfer mechanism previously described, to four corresponding second tooling stations 12*a*1–12*d*1, these being located to the rear of the press beyond the edge of the path of travel of the stock strip. The spacing and arrangement of the first tooling stations is such that, in coordination with the feed increments of the stock, successive blanks are removed from the stock and manufactured into pre-forms, leaving little connecting scrap material in the discharged stock strip, which then passes to a suitable chopper (not shown) in the same manner as previously described. All four of the transfer mechanisms are arranged in parallel, and the locations of the second tooling stations are arranged such that each is spaced a corresponding same distance from a first tooling station, whereby timing of the transfer of the pre-forms is essentially the same, and easily accomplished within the cycle time of the press. The completed shells are discharged from the second tooling stations, also along parallel paths, utilizing the same type of transfer discharge mechanisms previously described in connection with the embodiment as illustrated in FIG. 12.

Transfer by Slit and Carry

Figure 16:
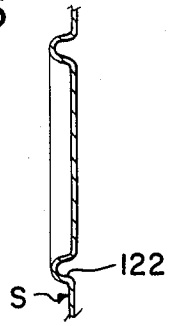
FIGS. 15 and 16 are views illustrating the manner in which the partially formed shells remain attached to the stock after operations at the first tool station.
Figure 15:
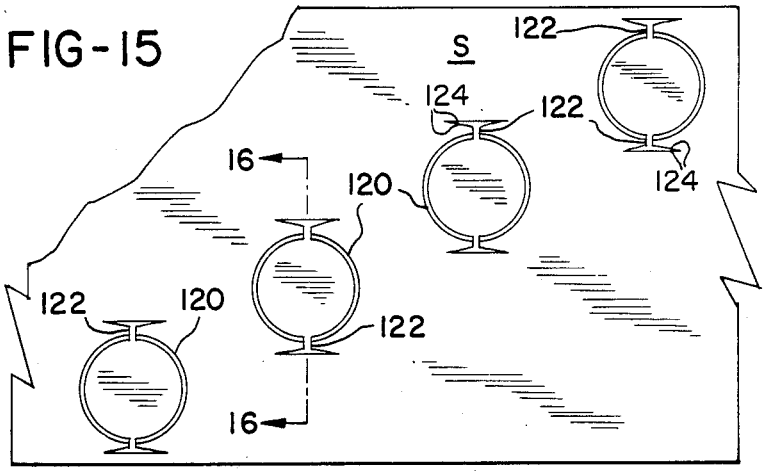
Figure 14:
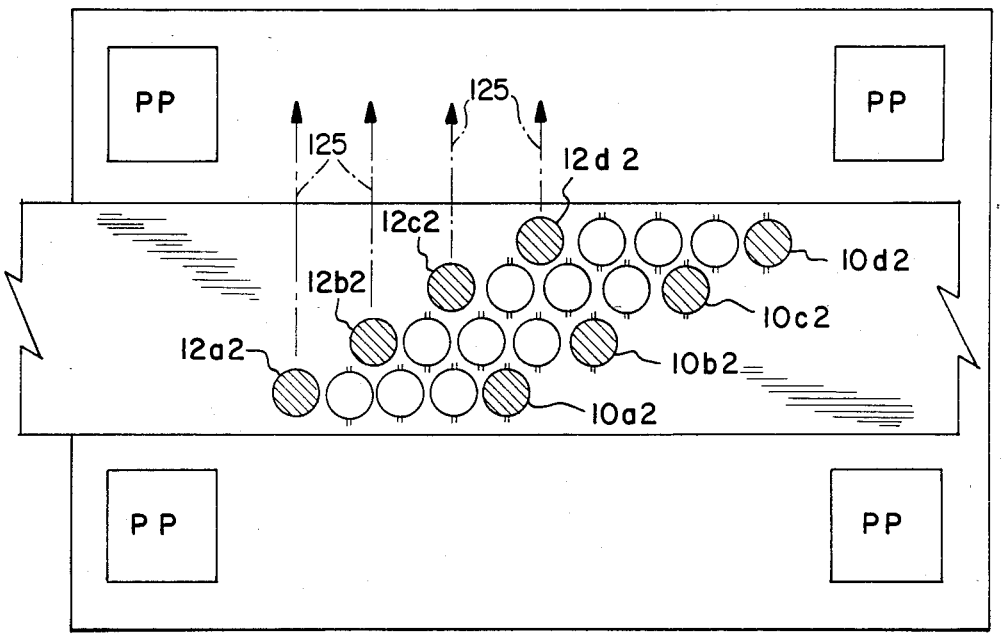
FIG. 14 is a schematic plan view of a further embodiment, in which the partially formed shells remain attached to the sheet stock at the first operating station, and are carried thereby to a second operating station.

FIGS. 14, 15 and 16 illustrate another embodiment which is characterized by a different scheme for transferring the shell pre-forms from first to second tool stations. The tooling layout on a press, and the stock feed, are shown in FIG. 14 as similar to the side-to-side stock path shown and described in connection with FIG. 13. However, the transfer mechanisms (such as shown schematically in FIG. 12) between the first and second tool stations are omitted. Instead, the pre-forms made at the first tool stations 10*a*–10*d* are retained integral with the stock strip S.

FIGS. 15 and 16 show this arrangement in greater detail. The die cut edge 14 (as in FIG. 5) is modified to be discontinuous, producing semi-circular cuts 120 ending at integral tabs 122 which continue to connect the pre-forms to the stock strips. Outside the tabs 122, slits 124 are formed in the stock, providing flexible links between each tab 122 and the adjoining area of the stock. In all other respects the pre-forms are completed (see FIG. 16) as in FIGS. 5–8.

The incremental advance of the stock then carries the pre-forms to the second tool stations 12*a*–12*d* where the shells are completed (as in FIGS. 9–11) and, in addition, the shells are severed from the tabs 122. The completed shells are discharged from the press in the direction of arrows 125, by suitable mechanisms such as the drivers 110*a*2–110*d*2 shown in FIG. 12. The scrap stock proceeds to a suitable chopper for reduction and collection.

Inverted Press System

Figure 17:
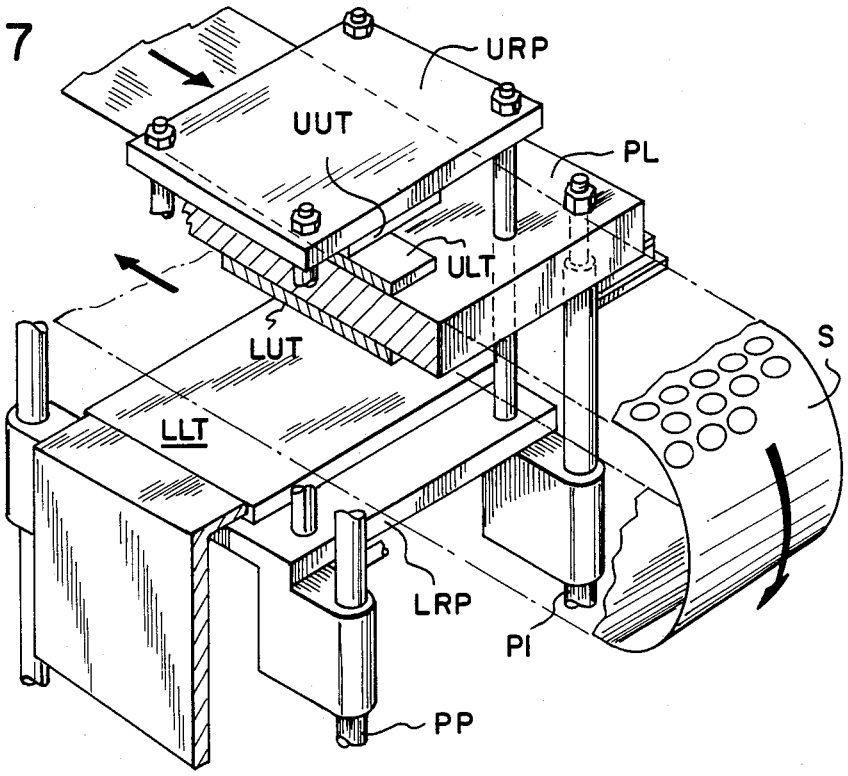
FIGS. 17 and 18 illustrate another embodiment using upper and lower tool stations in an inverted under-drive style of reciprocating press.
Figure 18:
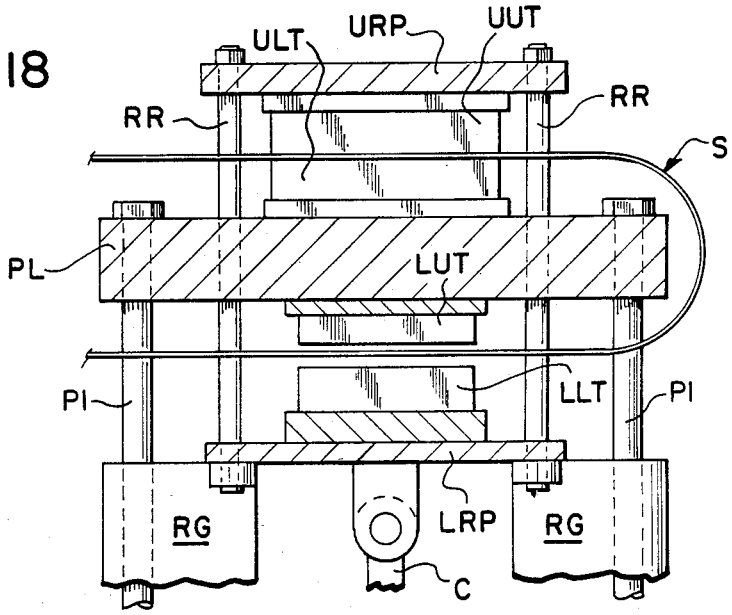

Another version of the integral slit/tab/carry arrangement is shown in FIGS. 17 and 18, in connection with an inverted press, for example of the type disclosed in U.S. Pat. No. 4,026,226. In such presses the motor, flywheel, and crankshaft are mounted in the bed, from which guideposts Pl extend upward and support a stationary tool plate PL. The reciprocating ram is a bi-level structure including a lower plate LRP and upper plate URP joined by rods RR which pass through the plate PL. The lower plate LRP has fastened to it suitable guides RG which slide along the guideposts Pl. Cranks C, driven from the crankshaft, are also connected to the ram structure to reciprocate it.

The first station upper and lower tools UUT and ULT are mounted respectively to the underside of ram plate URP and the top of stationary plate PL. These multiple tools produce in the stock strip S a plurality of shell pre-forms (as in FIGS. 15 and 16) during motion of the ram around top dead center. The strip carries the pre-forms to a corresponding multiple set of second station tools LUT and LLT which are mounted respectively to plate PL and to the lower ram plate LRP. During motion of the ram around bottom dead center, these tools complete the formation of the shells and sever them from the strip. The completed shells are discharged laterally of the stock strip path, and the skeleton scrap stock proceeds to a chopper, as in the other embodiments.

Two Press System

Figure 19:
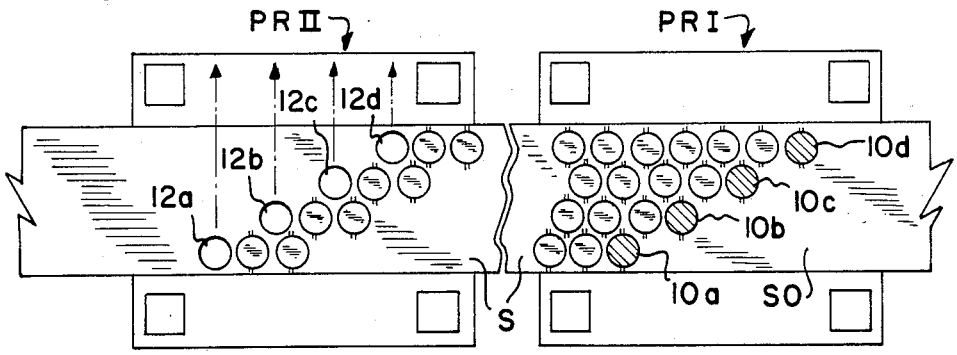
FIG. 19 illustrates a further embodiment employing two presses operating sequentially on stock, using the forming shown in FIGS. 15 and 16.

Another embodiment using the slit and carry technique is shown in FIG. 19. Here the first tool stations are located in a first press PRI, and are designated by the same reference numbers 10*a*–10*d*. The strip S carries the shell pre-forms to a second press PRII, in which the second tool stations 12*a*–12*d* are located. The shells are completed in the second press, severed from the strip, and discharged in the direction of the arrows thereon, with the skeleton scrap of the strip passing to a chopper as in the other embodiments.

Double Acting Press System

Figure 21:
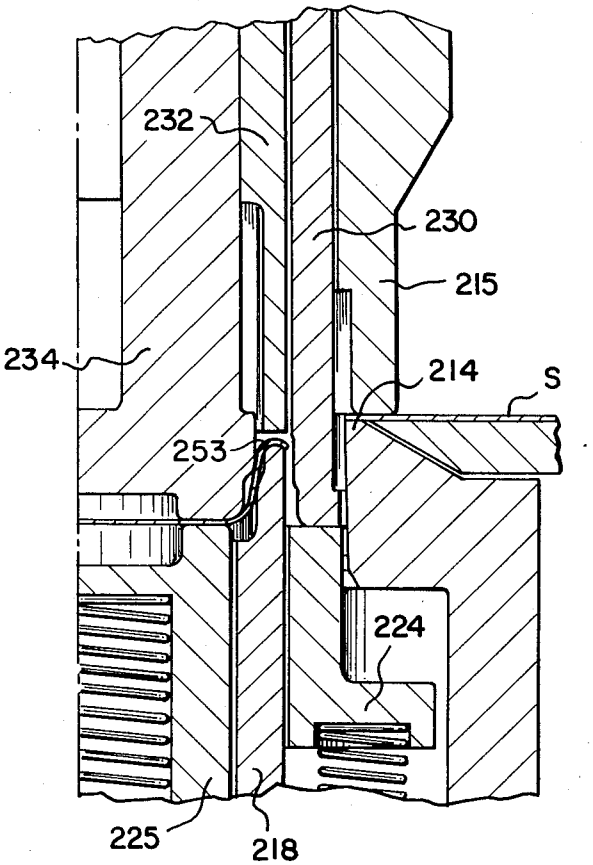
FIGS. 20 and 21 show first station tools for a double acting press.
Figure 20:
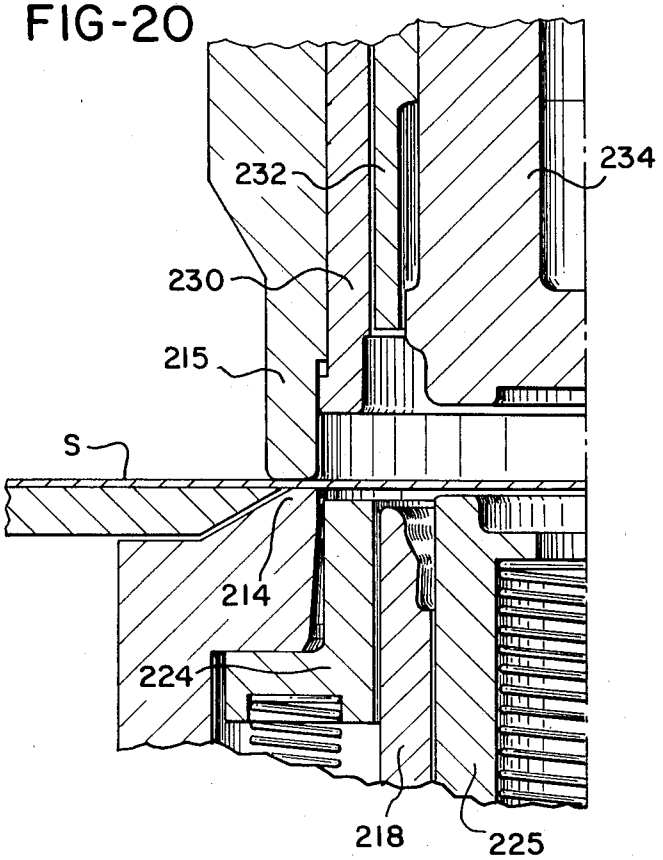

Tooling for the first stations in a double acting press is shown in FIGS. 20 and 21, it being understood the upper tooling is connected for operation by the primary and secondary press rams, while the lower tooling is fixed to the press frame at the top of the bed. In most essential features this tooling is comparable to the tools shown in FIGS. 5–8, and like reference numerals in the 200 series are used to designate like items.

The lower tooling includes die cut edge 214, over which the metal stock S enters the tooling. The stock is clamped against the die cut edge by a holder 215 driven by the secondary ram. Die cut edge 214, along with die form ring 218 are solidly supported on a suitable base member. A center pressure pad 225 is located concentrically within form ring 218, and draw ring 224 is supported by springs (mounted in the tool base) which compress due to pressure exerted upon the draw ring when the tooling is closed. The center pressure pad 225 is also supported by a spring which will compress in response to force exerted by the upper tooling.

When the tooling is open (FIG. 20), draw ring 224 and center pressure pad 225 are retained in the lower tooling with draw ring 224 bottoming against die cut edge 214 and center pressure pad 225 against form ring 218. The uppermost surface of draw ring 224 is then at a position some distance below the lowest point of shear on the die cut edge 214, while the uppermost surface of the center pressure pad 225 is above draw ring 224 and below the lowest point of shear on die cut edge 214.

The upper tooling includes blank punch 230, driven by the primary ram and positioned to cooperate with draw ring 224 as the tooling is closed. A knockout and positioner 232 is located above die form ring 218, and punch center 234 is provided with an appropriate configuration to produce the partially completed shell, as well as to clamp a blank in cooperation with center pressure pad 225. Blank punch 230, knockout and positioner 232, and punch center 234 are all closed simultaneously upon the lower tooling as the primary ram is lowered.

The sequential operation of the first station tooling to produce shell pre-forms is shown in FIGS. 20–21. In FIG. 20, the tooling is shown open except for holder 215. The stock S has entered the tooling and as the primary press ram is lowered the clampled stock material is cut between die cut edge 214 and blank punch 230. Since blank punch 230 and punch center 234 move simultaneously, the lower surface of blank punch 230 leads the lower surface of punch center 234 by a small amount so punch center 234 does not interfere with the stock during blanking.

The distance by which blank punch 230 leads punch center 234 is less than the distance at which the upper surface of pressure pad 225 is above the upper surface of draw ring 224. This causes the entire central panel of the blank to be clamped between punch center 234 and center pressure pad 225 first, followed by pinching of the outermost part of the blank between blank punch 230 and draw ring 224 before any forming begins.

As the primary press ram continues downward, the blank punch 230, support ring 232, and punch center 234 all continue to move simultaneously. Forming of the shell pre-form occurs as in FIGS. 6, 7 and 8.

In FIG. 21, the tooling is shown in its closed position with the primary press ram bottomed. The first portion of the shell formation operation is completed, with the flat central panel terminating at a relatively large radius area to produce a soft stretch so as not to overwork the material in this area. The large radius area forms the junction region of chuckwall CW with the central panel, and later forms the shell countersink and panel form radius.

The shell is further provided with a lip, as earlier described, extending generally outwardly and upwardly from the chuckwall but having general downward curvature. The lip is provided with two distinct curvatures, giving it the "gull-wing" cross-sectional configuration.

Upon closure of the tooling, knockout and positioner 232 does not contact the partly completed shell. Once the forming operation has been completed, both press rams raise to open the tooling, and the shell pre-form is held within blank punch 230 by the tight fit of its lip 253 therein, and is carried upward by the upper tooling. Once the lowermost portion of the shell pre-form has cleared the stock level, knockout and positioner 232 halts its upward movement while blank punch 230 and punch center 234 continue to rise. When upward movement of the knockout 232 is stopped the shell pre-form contacts it, and this pushes the shell pre-form from within the still-moving blank punch 230.

The partly formed shell is then held in position on knockout and positioner 232 through application of a vacuum, as previously described.

Upon completion of the first operation the shell preforms are moved to a corresponding one of a plurality of second station tools (FIGS. 22–24) for completion of the formation process.

Double Acting Second Station Tooling

Figure 22:
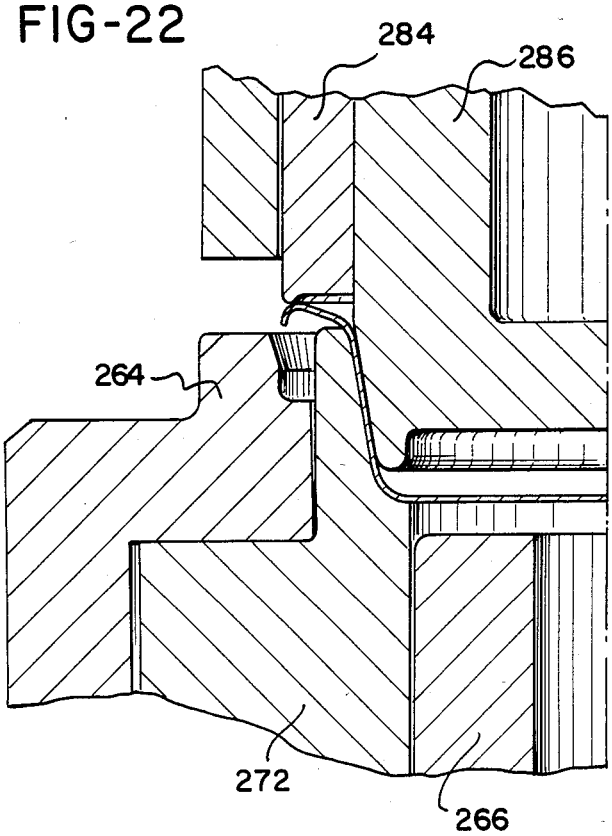
FIGS. 22, 23 and 24 show second station tools for a double acting press.
Figure 24:
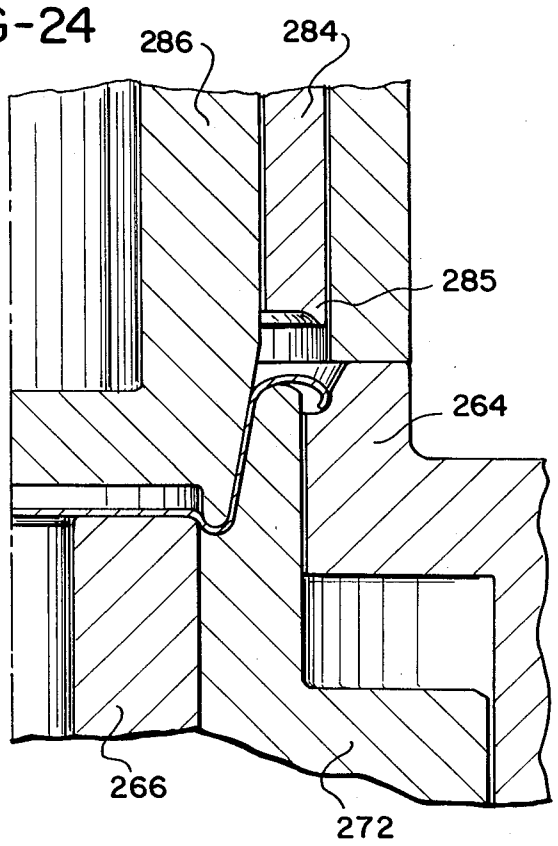
Figure 23:
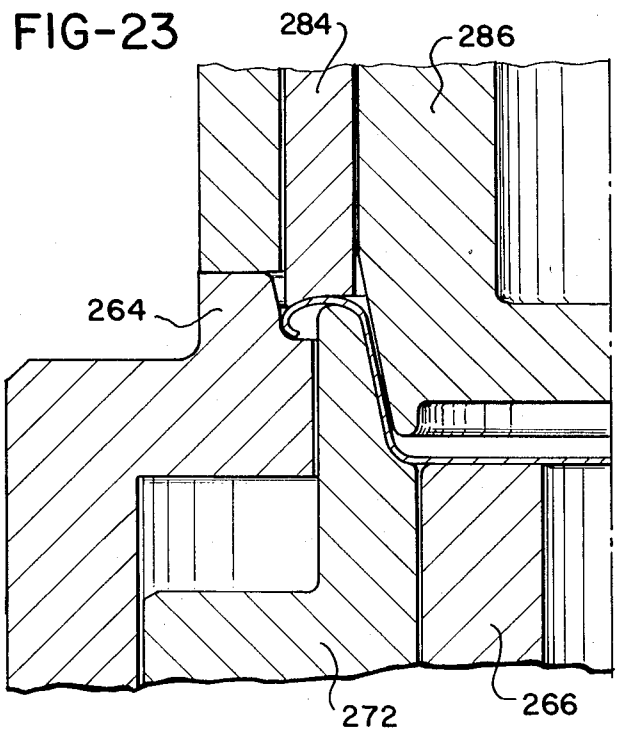

The tooling for the second station is shown in FIGS. 22–24, including upper tooling supported on the press ram and lower tooling supported on the press bed. The lower tooling includes a spring loaded curl die 264 and panel form punch 266, both fixed in turn to suitable base members. A spring pressure pad 272 is concentrically mounted between curl die 264 and panel form punch 266, supported by a plurality of springs (not shown) mounted within the base which supports the lower tooling. Vacuum passageways (not shown) supply vacuum to the upper surface of panel form punch 266.

The upper tooling includes a curl form punch and positioner 284 having a projection 285 defining the forming characteristics of the lower surface of the form punch, and operable by the secondary ram. Panel form die 286 is supported from the primary press ram through a plurality of springs (not shown), which are selected to provide a "dwell" in the downward movement of panel form die 286 as the primary ram is lowered. Further, vacuum passageways (not shown) are provided through panel form die 286, form punch and positioner 284, and their mounting respectively, thus vacuum may be supplied to the lower face of panel form die 286.

The sequential operation of the tooling of each of the second stations for completion of a shell is shown in detail in FIGS. 22–24. The shell pre-form enters the open tooling of the second station and is properly positioned on the lower tooling. The lip area 53 and chuckwall CW are supported by the spring pressure pad 72. The shell pre-form is located and held in place by the vacuum supplied to the upper surface of panel form punch 266.

In FIG. 22, lowering of both press rams causes panel form die 286 to contact chuckwall CW, clamping it between panel form die 286 and spring pressure pad 272. Due to lighter spring pressure on form die 286, once contact with chuckwall CW is made, panel form die 286 is held in position by the greater spring pressure against pad 272, and begins to dwell despite further lowering of the primary press ram. Subsequently, continued downward motion of the secondary ram causes form punch 284 to contact lip 53.

As seen in FIGS. 23 and 24, continued downward movement of the secondary ram causes the form punch and positioner 284 to push shell lip 53 to its intended final configuration. The shell pre-form continues to be clamped between panel form die 286 and spring pressure pad 272, with panel form die 286 continuing to dwell.

Further downward movement of the primary ram causes the panel form die 286 to move downward, as shown in FIG. 24, forcing the spring pressure pad 272 and the curl die 264 to move downward. The panel form punch 266 now is positioned against the central panel of the shell pre-form and downward movement of spring pressure pad 272 effectively causes upward movement of the panel with respect to the remainder of shell pre-form. The material from the large panel radius area is wrapped around the edges of the panel form punch 266 and the panel form die 286 (FIG. 24). The wrapping action takes place under precise control with little drawing of the shell material, reforming the large radius area 52 into the countersink CS.

It will be seen that, in this tooling, used in a double acting press, the final curl operation is completed, then the formation of the countersink is accomplished as a step following the curling operation.

While the methods and product herein described, and the forms of apparatus for carrying these methods into effect, constitute preferred embodiments of this invention, it is to be understood that the invention is not limited to these precise methods, product and forms of apparatus, and that changes may be made in either without departing from the scope of the invention, which is defined in the appended claims.

What is claimed is:

1. A method of forming shells such as used in the manufactured of can ends, comprising the steps of:

forming a plurality of blanks from a sheet of thin metal and then forming into each said blank a substantially flat central panel and an upward-extending chuckwall about the edge of said panel to produce a partially formed shell, the junction area between each said panel and adjacent said chuckwall defining a relatively large radius of curvature;

forming into each of said blanks a lip extending outward from the upper end of said chuckwall and generally parallel to said panel;

gripping the chuckwall and moving the central panel upward relative to the chuckwall, while simultaneously wrapping said junction areas around forming punches to form panel walls in said junction areas extending upward from the inner part of said chuckwall.

2. The method of claim 1, including the additional step of forming each lip into a curl edge section having inner and outer portions, the outer curl edge section having a lesser radius of curvature than the inner curl edge section.

3. The method of claim 2, wherein the additional step of forming the curl edge section is performed at least in part during forming of the panel wall.

4. The method of claim 1, wherein the forming steps occur at a first tool station and the gripping and wrapping steps occur at a second tool station.

5. The method of claim 4, wherein the forming of said blanks at the first station is performed by a first set of reciprocably relatively moving upper and lower tooling mounted in a press.

6. The method of claim 5, including separating the blanks from the sheet metal at the first set of tooling, and then transferring the partially formed blanks to a separate location for completion of the remaining steps.

7. The method of claim 5, wherein the gripping and wrapping steps are performed by a second set of reciprocably relatively moving upper and lower tooling so as to complete forming of said shell therebetween.

8. The method of claim 7, including partially separating the blanks from the sheet metal at the first set of tooling, using the sheet metal to carry the partially formed blanks to the second set of tooling.

9. The method of claim 7, wherein the first and said second tooling sets are mounted in and driven by the same reciprocating press.

10. The method of claim 9, wherein the tooling is arranged such that the first station is located centrally of the press along the in-feed path of the sheet metal, and the second station is located on opposite sides of such path.

11. The method of claim 9, wherein the tooling is arranged such that the first station and second station are located in the press arranged sequentially along the in-feed path of the sheet metal.

12. The method of claim 8, wherein the first and the second tooling sets are mounted in and driven by the same reciprocating press, and wherein the tooling is arranged such that the first and second stations are located in stacked relation and the feed path of the sheet metal is looped 180° from the first station to the second station.

13. The method of claim 8, wherein the first and second tooling sets are located in separate first and second presses, and the partially completed shells from the first tooling set are transferred from the first press to the second press.

14. A shell made by the method of claim 1.

15. A shell made by the method defined in claim 2.

16. A shell made by the method defined in claim 7.

17. Apparatus for forming shells for can ends from a strip of thin sheet metal by reciprocating tool operations, comprising:

a first set of tooling including a blank punch and die and draw ring constructed and arranged to define and at least partially to separate a plurality of blanks from the strip, a form ring and punch cooperating to form an upwardly and outwardly extending chuckwall surrounding a central panel on each blank, said draw ring, form ring, blank punch and punch center cooperating to form a partial curl on the outer part of the blanks, a second set of tooling receiving partially formed blanks from said first set of tooling and including, a panel form die and a pressure pad constructed and arranged to grip the wall of the partially formed blanks inward of the partial curl and outward of the central panel, said panel form die including a nose portion defining the shape of a panel wall interconnecting the chuckwall and the central panel, a panel form punch cooperating with said panel form die to wrap the region of the blank between the central panel and the gripped chuckwall around said nose portion, and a curl form punch and a curl form die constructed and arranged to complete the curl on the outer part of the shell by forming the edge of the shell extending inwardly beneath the curl at a uniform spacing from the chuckwall, means defining a work path through said apparatus, said first set of tooling and said second set of tooling being disposed along said work path, said path defining means including means for feeding the strip to said first set of tooling, means for directing the partially formed blanks from said first set of tooling to said second set of tooling, and means for discharging the shells from said second set of tooling.

18. Apparatus for forming shells, as defined in claim 17, wherein said first and second sets of tooling are constructed and arranged for mounting adjacent each other in a reciprocating press.

19. Apparatus for forming shells, as defined in claim 17, wherein said blank punch is constructed to separate completely the blanks from the strip in the first set of tooling.

20. Apparatus for forming shells, as defined in claim 17, wherein said blank punch is constructed to leave integral tab connections between the blank and the strip, and said means for directing partially formed blanks includes the strip which functions as a carrier for moving the blanks into said second set of tooling.

21. Apparatus for forming shells, as defined in claim 17, including a press means having a bed and a ram mounting said tool punches and dies, means connected to said ram for reciprocating said ram toward and away from said bed, and said strip feeding means being constructed for feeding the strip of metal incrementally into said tooling along a portion of said work path defining a predetermined feed path.

22. Apparatus as defined in claim 21, wherein said feeding means is arranged to feed the strip in a front-back direction through said press means, said first set of tooling being mounted along said feed path, said second set of tooling being mounted on opposite sides of said feed path, and said discharging means extending toward the sides of said press means.

23. Apparatus as defined in claim 21, wherein said feeding means is arranged to feed the strip in a sideways direction through said press means, said first set of tooling being mounted along said feed path, said second set of tooling being mounted to one side of said feed path, said discharging means extending from said second set of tooling in a front-back direction through said press means away from said feed path.

24. Apparatus as defined in claim 21, wherein said press means has upper and lower tooling positions and said first and second sets of tooling are mounted at respective ones of said positions, said feeding means being arranged to feed the strip through said first tooling set, around a 180° loop, and through said second tooling set.

25. Apparatus as defined in claim 21, wherein said press means includes two presses, one press incorporating said first set of tooling and the other press incorporating the second set of tooling, said feeding means being arranged to feed the strip through said first and second presses, and said discharging means being located in said second press.

26. Apparatus as defined in claim 17, wherein said press means is a single acting reciprocating press.

27. Apparatus as defined in claim 17, wherein said press means is a double acting reciprocating press.

28. Apparatus as defined in claim 17, wherein said press means is a single acting press having means for supporting and operating two sets of tooling in alternative fashion.

* * * * *